US008805249B2

(12) United States Patent
Ishii et al.

(10) Patent No.: US 8,805,249 B2
(45) Date of Patent: Aug. 12, 2014

(54) IMAGE FORMING APPARATUS

(75) Inventors: Yasutomo Ishii, Kanagawa (JP); Makoto Kanno, Kanagawa (JP); Yuji Sakoda, Kanagawa (JP); Kiyohito Horii, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 210 days.

(21) Appl. No.: 13/561,936

(22) Filed: Jul. 30, 2012

(65) Prior Publication Data

US 2013/0251415 A1 Sep. 26, 2013

(30) Foreign Application Priority Data

Mar. 22, 2012 (JP) ..... 2012-065709

(51) Int. Cl.
*G03G 15/09* (2006.01)

(52) U.S. Cl.
USPC ..... 399/274

(58) Field of Classification Search
CPC ..... G03G 15/0921; G03G 15/0812
USPC ..... 399/274, 273, 268
See application file for complete search history.

(56) References Cited

U.S. PATENT DOCUMENTS 6,512,908 B2 * 1/2003 Mitamura
8,290,409 B2 * 10/2012 Stelter et al.
2008/0226355 A1 9/2008 Koetsuka et al.
2008/0273900 A1 * 11/2008 Dobbertin et al.
2011/0052271 A1 * 3/2011 Akedo ..... 399/274

FOREIGN PATENT DOCUMENTS

JP 2004-094235 A 3/2004
JP 2004-198539 A 7/2004
JP 2007-334182 A 12/2007
JP 2008-225316 A 9/2008

* cited by examiner

*Primary Examiner* — Susan Lee
(74) *Attorney, Agent, or Firm* — Sughrue Mion, PLLC

(57) ABSTRACT

An image forming apparatus includes an image carrying member, a developer carrying member facing the image carrying member in a horizontal direction and configured to carry a developer containing magnetic particles and to rotate in a circumferential direction thereof, a transport pole provided inside the developer carrying member and above a center of rotation of the developer carrying member and allowing the developer carrying member to transport the developer, and a developer regulating member facing the developer carrying member at a position between the transport pole and the image carrying member in a direction of rotation of the developer carrying member and configured to regulate a thickness of the developer on the developer carrying member. The developer accumulates at a position where an amount of bending in the developer carrying member in a vertical direction becomes larger than or equal to that in the horizontal direction.

3 Claims, 8 Drawing Sheets

IMAGE FORMING APPARATUS

CROSS-REFERENCE TO RELATED APPLICATIONS

This application is based on and claims priority under 35 USC 119 from Japanese Patent Application No. 2012-065709 filed Mar. 22, 2012.

BACKGROUND

Technical Field

The present invention relates to an image forming apparatus.

SUMMARY

According to an aspect of the invention, there is provided an image forming apparatus including an image carrying member configured to carry a latent image on an outer circumferential surface thereof; a developer carrying member having a substantially cylindrical shape and rotatably supported at two ends thereof, the developer carrying member facing the image carrying member in a horizontal direction and being configured to carry on an outer circumferential surface thereof a developer containing magnetic particles and to rotate in a circumferential direction thereof; a transport pole provided inside the developer carrying member and above a center of rotation of the developer carrying member in a vertical direction, the transport pole being one of a plurality of magnetic poles included in a magnetic-force-generating member that are arranged in the circumferential direction of the developer carrying member, the transport pole allowing the developer carrying member to transport the developer while the developer carrying member is rotating; and a developer regulating member facing the developer carrying member at a position between the transport pole and the image carrying member in a direction of rotation of the developer carrying member and configured to regulate a thickness of a layer of the developer on the outer circumferential surface of the developer carrying member, the developer regulating member being provided at such a position that, when the developer carrying member rotates, the developer accumulates at a position where a first amount of bending in the developer carrying member in the vertical direction becomes larger than or equal to a second amount of bending in the developer carrying member in the horizontal direction.

BRIEF DESCRIPTION OF THE DRAWINGS

An exemplary embodiment of the present invention will be described in detail based on the following figures, wherein.

DETAILED DESCRIPTION

An image forming apparatus according to an exemplary embodiment of the present invention will now be described.

Overall Configuration

Figure 1:
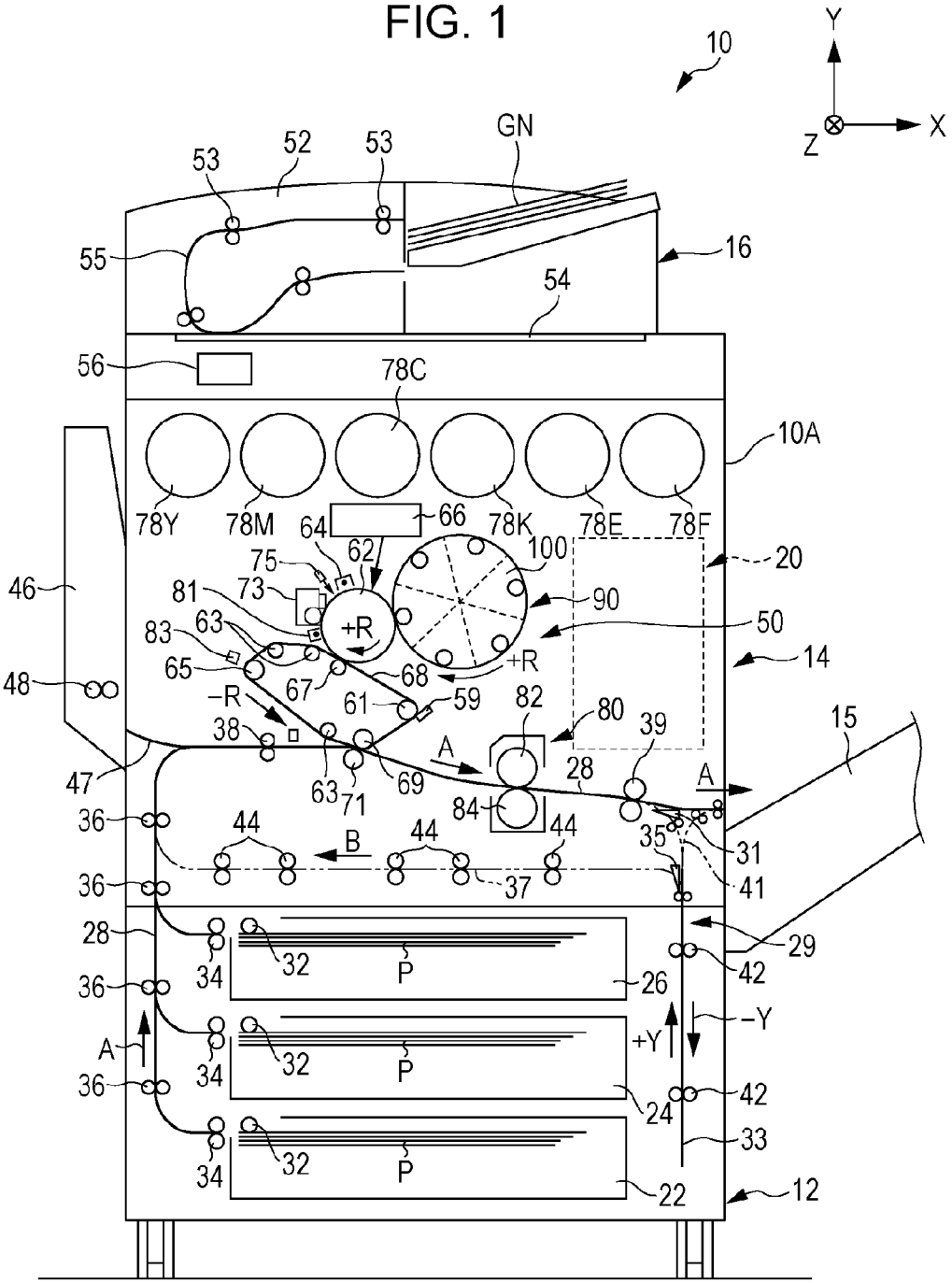
FIG. 1 illustrates an overall configuration of an image forming apparatus according to the exemplary embodiment of the present invention.

FIG. 1 illustrates an image forming apparatus 10 according to the exemplary embodiment. The image forming apparatus 10 includes, from the bottom to the top thereof in the vertical direction (the direction of arrow Y), a sheet storing section 12 in which recording sheets P as exemplary recording media are stored, an image forming section 14 that is provided above the sheet storing section 12 and forms an image on each of the recording sheets P fed thereto from the sheet storing section 12, a document reading section 16 that is provided above the image forming section 14 and reads a document GN, and a controller 20 that is provided in the image forming section 14 and controls operations of elements included in the image forming apparatus 10. Hereinafter, the vertical direction, the horizontal direction, and the depth direction from the near side toward the rear side in the front view of an apparatus body 10A of the image forming apparatus 10 are referred to as Y direction, X direction, and Z direction, respectively.

The sheet storing section 12 includes a first storage unit 22, a second storage unit 24, and a third storage unit 26 that store recording sheets P of different sizes, respectively. The first storage unit 22, the second storage unit 24, and the third storage unit 26 are provided with feed rollers 32, respectively, that feed the recording sheets P stored into a transport path 28 defined in the image forming apparatus 10. Pairs of transport rollers 34 and pairs of transport rollers 36 are provided in the transport path 28 on the downstream side of the feed rollers 32. The transport rollers 34 and 36 transport each of the recording sheets P. Registration rollers 38 are provided at a position of the transport path 28 that is on the downstream side of the transport rollers 36 in the direction of transport of the recording sheet P. The registration rollers 38 temporarily stop the recording sheet P and then feed the recording sheet P to a second transfer position QB, to be described separately below referring to FIG. 2, with a predetermined timing.

An upstream portion of the transport path 28 (a portion where the transport rollers 36 are provided) extends, in the front view of the image forming apparatus 10, linearly in the Y direction on the left side of the sheet storing section 12 to the lower left of the image forming section 14. A downstream portion of the transport path 28 extends from the lower left of the image forming section 14 to a sheet output portion 15 provided on the right sidewall of the image forming section 14. The transport path 28 is connected to a duplex transport path 29 into which the recording sheet P is transported and in which the recording sheet P is reversed so that images are formed on both sides of the recording sheet P.

The duplex transport path 29 includes, in the front view of the image forming apparatus 10, a first switching member 31 that switches the transport path between the transport path 28 and the duplex transport path 29, a reversing portion 33 that extends from the lower right of the image forming section 14 linearly in the Y direction (the downward direction and the upward direction are denoted by −Y and +Y, respectively, in FIG. 1) along the right side of the sheet storing section 12, a transport portion 37 into which the trailing end of the recording sheet P having been transported into the reversing portion 33 is introduced and along which the recording sheet P is transported in the X direction toward the left side in FIG. 1, and a second switching member 35 that switches the transport path between the reversing portion 33 and the transport portion 37. Pairs of transport rollers 42 are provided at plural positions of the reversing portion 33 at certain intervals. Pairs of transport rollers 44 are provided at plural positions of the transport portion 37 at certain intervals. A transport path 41 is provided above the reversing portion 33. The recording sheet P having been transported into the reversing portion 33 is transported into the transport path 41 simply for the reversal of the recording sheet P, not for duplex image formation. An end of the transport path 41 is connected to the sheet output portion 15.

The first switching member 31 has a triangular-prism shape and is moved by a drive unit (not illustrated) such that the tip thereof is oriented toward either of the transport path 28 and the duplex transport path 29, whereby the direction of transport of the recording sheet P is switched. Likewise, the second switching member 35 has a triangular-prism shape and is moved by a drive unit (not illustrated) such that the tip thereof is oriented toward either of the reversing portion 33 and the transport portion 37, whereby the direction of transport of the recording sheet P is switched.

A downstream end of the transport portion 37 is connected to the transport path 28 with a guide member (not illustrated) provided before (on the upstream side of) the most downstream one of the pairs of transport rollers 36 provided in the upstream portion of the transport path 28. A foldable manual feed portion 46 is provided on the left sidewall of the image forming section 14. A transport path 47 into which the recording sheet P is fed from the manual feed portion 46 by transport rollers 48 is connected to a portion of the transport path 28 before (on the upstream side of) the registration rollers 38.

The document reading section 16 includes a document transport device 52 that automatically transports each piece of document GN, a platen glass 54 provided below the document transport device 52 and on which a piece of document GN is to be placed, and a document reading device 56 that reads the piece of document GN having been transported by the document transport device 52 or having been placed on the platen glass 54.

The document transport device 52 has an automatic transport path 55 along which pairs of transport rollers 53 are provided. A portion of the automatic transport path 55 is defined such that the piece of document GN runs on the platen glass 54. The document reading device 56 is stationary below the left end of the platen glass 54 when reading the piece of document GN having been transported by the document transport device 52, or moves in the X direction when reading the piece of document GN having been placed on the platen glass 54.

The image forming section 14 includes an image forming unit 50 that forms a toner image (a developer image) on the recording sheet P. The image forming unit 50 includes a photoconductor 62, a charger 64, an exposure device 66, a development unit 90, an intermediate transfer belt 68, and a cleaning unit 73, all of which will be described below.

The photoconductor 62, which is an exemplary image carrying member, has a cylindrical shape and is provided in the middle part of the image forming section 14 in the apparatus body 10A. The photoconductor 62 is driven by a drive unit (not illustrated) in such a manner as to rotate in the direction of arrow +R (in the clockwise direction in FIG. 1) and is configured to carry an electrostatic latent image to be formed on the outer circumferential surface thereof, the electrostatic latent image being formed with light to be applied to the photoconductor 62. The charger 64, which is, for example, a corotron charger, charges the outer circumferential surface of the photoconductor 62 and is provided above the photoconductor 62 in such a manner as to face the outer circumferential surface of the photoconductor 62.

The exposure device 66 is provided on the downstream side of the charger 64 and on the upstream side of the development unit 90 in the direction of rotation of the photoconductor 62 in such a manner as to face the outer circumferential surface of the photoconductor 62. The exposure device 66 includes a semiconductor laser, an f-θ lens, a polygonal mirror, an imaging lens, and plural mirrors (all not illustrated). The exposure device 66 is configured to perform exposure by applying laser light (exposure light) to the outer circumferential surface of the photoconductor 62 having been charged by the charger 64. The laser light is emitted from the semiconductor laser and is scanningly deflected by the polygonal mirror in accordance with an image signal. Thus, an electrostatic latent image is formed on the outer circumferential surface of the photoconductor 62. The exposure device 66 is not limited to a device that scanningly deflects laser light with a polygonal mirror, and may alternatively employ light-emitting diodes (LEDs).

The development unit 90 faces a position of the photoconductor 62 that is on the downstream side in the direction of rotation of the photoconductor 62 with respect to a position to which the exposure device 66 applies the exposure light. The development unit 90, which is of a rotary switching type, develops and visualizes, with toners having predetermined colors, the electrostatic latent image having been formed on the outer circumferential surface of the photoconductor 62. The development unit 90 will be described in detail separately below.

Figure 2:
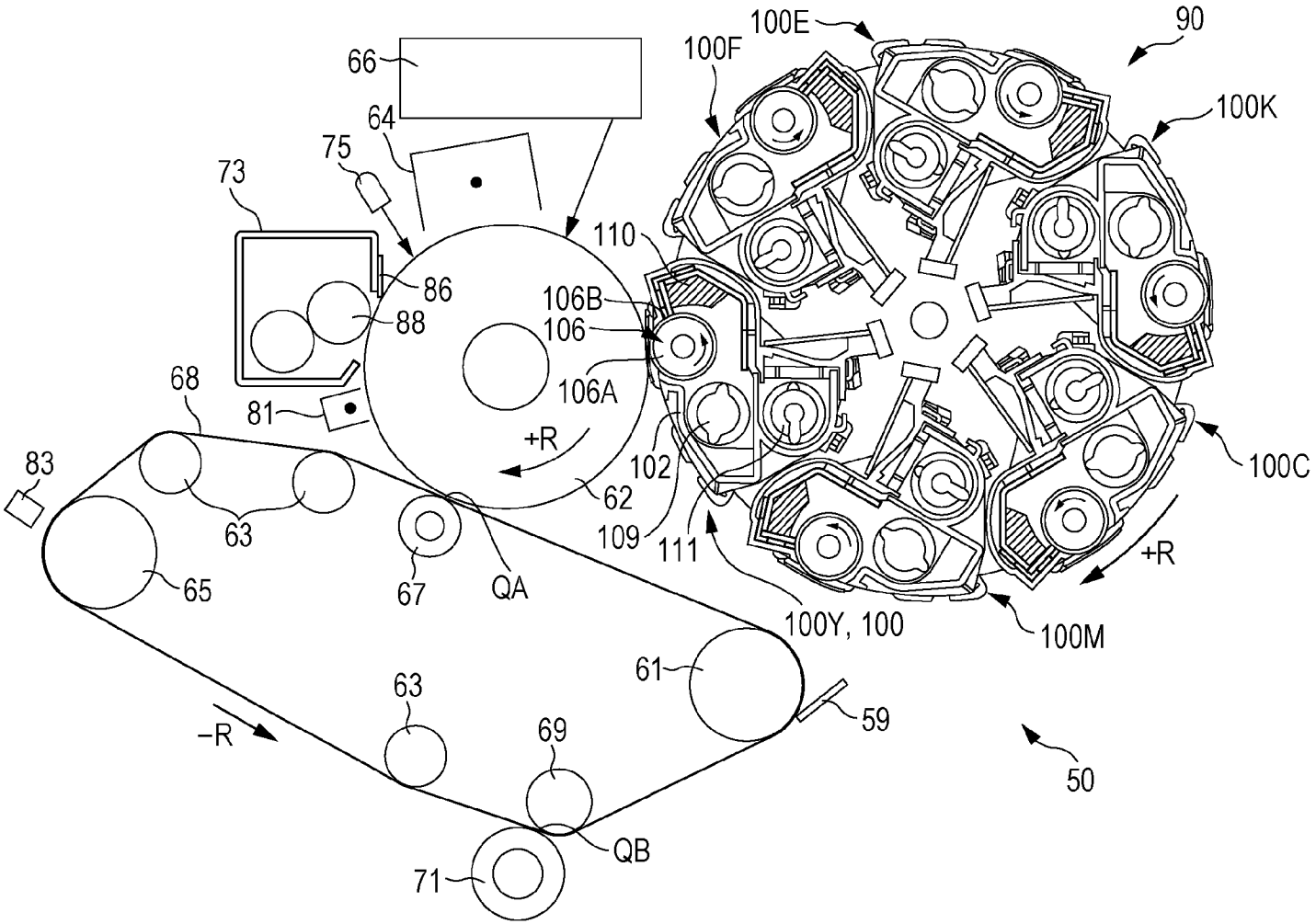
FIG. 2 illustrates a configuration of an image forming unit according to the exemplary embodiment of the present invention.

Referring to FIG. 2, the intermediate transfer belt 68 is provided on the downstream side of the development unit 90 in the direction of rotation of the photoconductor 62 and below the photoconductor 62. The toner image having been formed on the outer circumferential surface of the photoconductor 62 is transferred to the intermediate transfer belt 68. The intermediate transfer belt 68 is endless and is stretched around a driving roller 61 that is driven to rotate by the controller 20 (see FIG. 1), plural transport rollers 63 that are in contact with the inner surface of the intermediate transfer belt 68 and rotate by following the rotation of the intermediate transfer belt 68, a tension applying roller 65 that applies tension to the intermediate transfer belt 68, and an assist roller 69 that is in contact with the inner surface of the intermediate transfer belt 68 and rotates by following the rotation of the intermediate transfer belt 68. The assist roller 69 is provided at the second transfer position QB to be described below. When the driving roller 61 rotates, the intermediate transfer belt 68 rotates in the direction of arrow −R (in the counterclockwise direction in FIG. 2).

A first transfer roller 67 is provided across the intermediate transfer belt 68 from the photoconductor 62. The first transfer roller 67 first-transfers the toner image having been formed on the outer circumferential surface of the photoconductor 62 to the intermediate transfer belt 68. The first transfer roller 67 is in contact with the inner surface of the intermediate transfer belt 68 at a position on the downstream side in the direction of rotation of the intermediate transfer belt 68 with respect to a position (first transfer position QA) at which the photoconductor 62 is in contact with the intermediate transfer belt 68. When power is supplied to the first transfer roller 67 from a power source (not illustrated), the first transfer roller 67 first-transfers the toner image on the photoconductor 62 to the intermediate transfer belt 68 by utilizing the potential difference from the photoconductor 62, which is grounded.

A second transfer roller 71 is provided across the intermediate transfer belt 68 from the assist roller 69. The second transfer roller 71 second-transfers the toner image having been first-transferred to the intermediate transfer belt 68 to the recording sheet P. The nip between the second transfer roller 71 and the assist roller 69 is defined as the second transfer position QB, at which the toner image is transferred to the recording sheet P. The second transfer roller 71 is grounded and is in contact with the outer surface of the intermediate transfer belt 68. The second transfer roller 71 second-transfers the toner image on the intermediate transfer belt 68 to the recording sheet P by utilizing the potential difference from the assist roller 69 that is powered by a power source (not illustrated). The second transfer position QB is set at a halfway position on the transport path 28 (see FIG. 1).

A cleaning blade 59 as an exemplary cleaning device is provided across the intermediate transfer belt 68 from the driving roller 61. The cleaning blade 59 collects (removes) toner residues from the intermediate transfer belt 68 after the second transfer.

A position detecting sensor 83 is provided at a position near the outer circumference of the intermediate transfer belt 68 and facing the tension applying roller 65. The position detecting sensor 83 detects a predetermined reference position, which is defined on the intermediate transfer belt 68, by detecting a mark (not illustrated) provided on the outer surface of the intermediate transfer belt 68. The position detecting sensor 83 outputs a position detection signal with reference to which an image forming process is started. The position detecting sensor 83 detects the movement of the intermediate transfer belt 68 by emitting light toward the intermediate transfer belt 68 and receiving the reflection from the mark on the outer surface of the intermediate transfer belt 68.

The cleaning unit 73 is provided on the downstream side of the first transfer roller 67 in the direction of rotation of the photoconductor 62. The cleaning unit 73 removes unwanted matter including toner residues not having been first-transferred to the intermediate transfer belt 68 and remaining on the surface of the photoconductor 62. The cleaning unit 73 collects toner residues by using a cleaning blade 86 and a brush roller 88. The cleaning blade 86 is provided in contact with the surface of the photoconductor 62.

A first static eliminating unit 81 is provided on the upstream side of the cleaning unit 73 in the direction of rotation of the photoconductor 62 (on the downstream side of the first transfer roller 67). The first static eliminating unit 81 eliminates any static electricity of the toner residues remaining on the outer circumferential surface of the photoconductor 62 after the first transfer. Furthermore, a second static eliminating unit 75 is provided on the downstream side of the cleaning unit 73 (on the upstream side of the charger 64) in the direction of rotation of the photoconductor 62. The second static eliminating unit 75 eliminates any charge remaining on the outer circumferential surface of the photoconductor 62 after the cleaning.

Referring to FIG. 1, a fixing device 80 is provided on the downstream side of the second transfer roller 71 in the direction of transport of the recording sheet P. The fixing device 80 fixes, on the recording sheet P, the toner image having been transferred to the recording sheet P by the second transfer roller 71. The fixing device 80 includes a heat roller 82 and a pressure roller 84. The heat roller 82 includes a heat source provided thereinside. The pressure roller 84 presses the recording sheet P against the heat roller 82. Transport rollers 39 are provided on the downstream side of the fixing device 80 in the direction of transport of the recording sheet P. The transport rollers 39 transport the recording sheet P toward the sheet output portion 15 or the reversing portion 33.

Toner cartridges 78Y, 78M, 78C, 78K, 78E, and 78F that are individually replaceable are provided side by side in the X direction below the document reading device 56 and above the development unit 90. The toner cartridges 78Y, 78M, 78C, 78K, 78E, and 78F contain toners having respective colors of yellow (Y), magenta (M), cyan (C), black (K), a first special color (E), and a second special color (F).

An image forming process performed by the image forming apparatus 10 will now be described.

Referring to FIG. 1, when the image forming apparatus 10 is activated, pieces of image data for the respective colors of yellow (Y), magenta (M), cyan (C), black (K), the first special color (E), and the second special color (F) are sequentially output to the exposure device 66 from an image processing apparatus (not illustrated) or any external apparatus. In this step, the development unit 90 is rotated and is retained such that, for example, a development device 100Y (to be described below referring to FIG. 2) faces the outer circumferential surface of the photoconductor 62.

Subsequently, light is emitted from the exposure device 66 in accordance with the piece of image data for yellow, and the outer circumferential surface of the photoconductor 62 having been charged by the charger 64 is exposed to the light. Thus, an electrostatic latent image corresponding to the piece of image data for yellow is formed on the outer circumferential surface of the photoconductor 62. The electrostatic latent image thus formed on the outer circumferential surface of the photoconductor 62 is developed into a yellow toner image by the development device 100Y. The yellow toner image on the outer circumferential surface of the photoconductor 62 is then transferred to the intermediate transfer belt 68 by the first transfer roller 67.

Subsequently, referring to FIG. 2, the development unit 90 is rotated by 60 degrees in the direction of arrow +R, whereby a development device 100M comes to face the outer circumferential surface of the photoconductor 62. Through the processes of charging, exposure, and development, a magenta toner image is formed on the outer circumferential surface of the photoconductor 62 and is transferred to the intermediate transfer belt 68 by the first transfer roller 67 in such a manner as to be superposed on the yellow toner image. Likewise, toner images in cyan (C) and black (K), as well as toner images in the first special color (E) and the second special color (F) according to color settings, are sequentially and multiply transferred to the intermediate transfer belt 68.

Meanwhile, referring to FIG. 1, the recording sheet P that has been fed from the sheet storing section 12 and has been transported along the transport path 28 is transported to the second transfer position QB (see FIG. 2) by the registration rollers 38 in accordance with the timing of the multiple transfer of the toner images to the intermediate transfer belt 68. The toner images that have been multiply transferred to the intermediate transfer belt 68 are second-transferred by the second transfer roller 71 to the recording sheet P that has been transported to the second transfer position QB.

Subsequently, the recording sheet P having the toner images transferred thereto is transported in the direction of arrow A (rightward in FIG. 1) toward the fixing device 80. In the fixing device 80, heat and pressure are applied to the toner images by the heat roller 82 and the pressure roller 84, whereby the toner images are fixed on the recording sheet P. Furthermore, the recording sheet P having the fixed toner images is output to, for example, the sheet output portion 15.

If images are to be formed on both sides of the recording sheet P, the recording sheet P having on the front side thereof the toner images fixed by the fixing device 80 is fed into the reversing portion 33 in the direction of arrow −Y and is then fed out of the reversing portion 33 in the direction of arrow +Y, whereby the leading end and the trailing end of the recording sheet P are reversed. Subsequently, the recording sheet P is transported in the direction of arrow B (leftward in FIG. 1) along the transport portion 37 and is fed into the transport path 28. Then, image formation and fixing are performed on the back side of the recording sheet P.

Feature Configuration

The development unit 90 and development devices 100 will now be described.

Referring to FIG. 2, the development unit 90 includes, for example, development devices 100Y, 100M, 100C, 100K, 100E, and 100F that are provided in correspondence with the different toner colors of yellow (Y), magenta (M), cyan (C), black (K), the first special color (E), and the second special color (F) and are arranged in the circumferential direction (in that order in the counterclockwise direction in FIG. 2). The development unit 90 is rotated by a center angle of 60 degrees at a time by a motor (not illustrated), whereby the development device to be used for development is switched among the development devices 100Y, 100M, 100C, 100K, 100E, and 100F and comes to face the outer circumferential surface of the image carrier 62.

Since the development devices 100Y, 100M, 100C, 100K, 100E, and 100F all have the same configuration except developers (toners) to be used, the development device 100Y will be described below as the development device 100. Description of the other development devices 100M, 100C, 100K, 100E, and 100F is therefore omitted. In a case where an image is formed by using four colors of Y, M, C, and K, the development devices 100E and 100F are not used. Therefore, the development unit 90 is rotated by 180 degrees when switching from the development device 100K to the development device 100Y.

Figure 3:
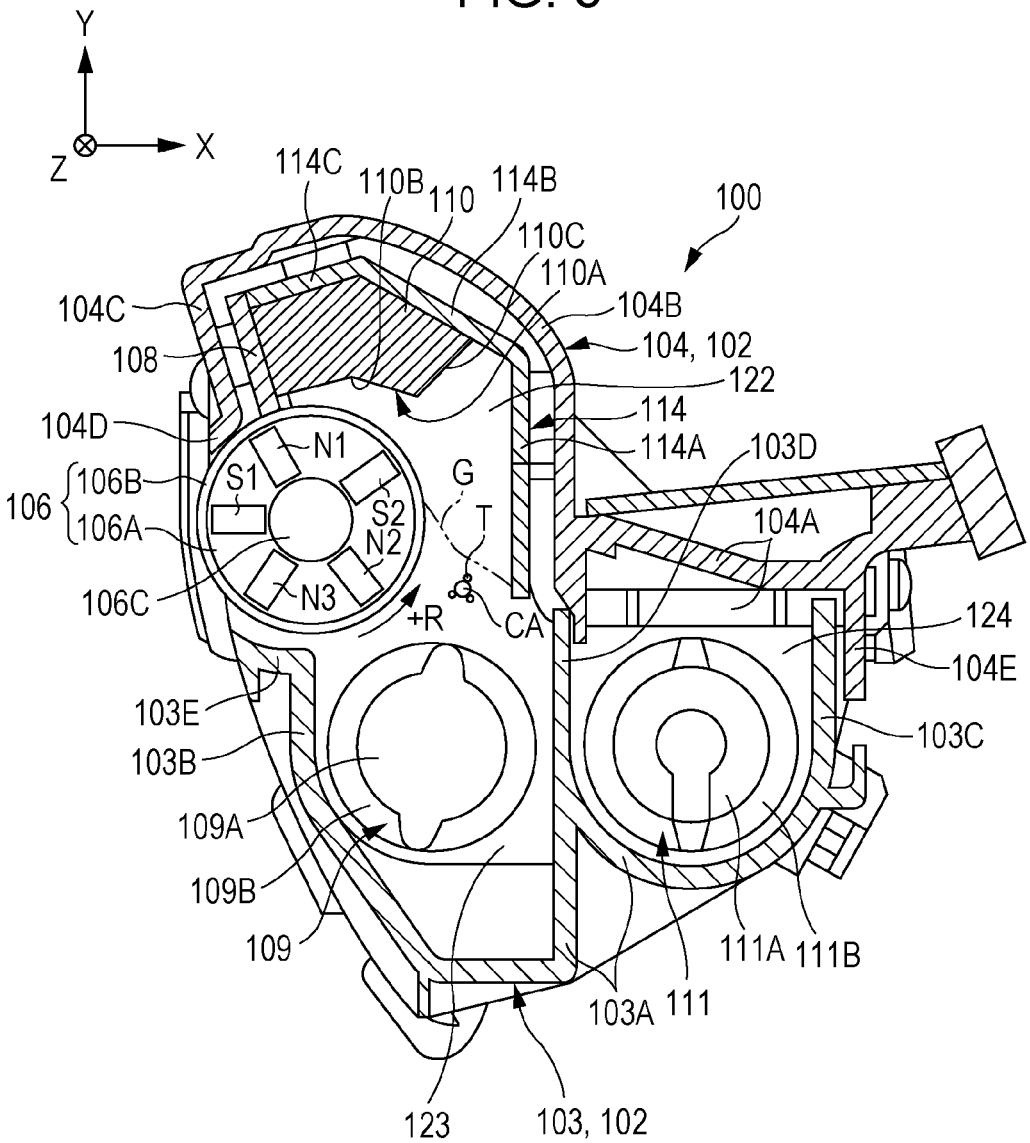
FIG. 3 illustrates a configuration of a development device according to the exemplary embodiment of the present invention.

Referring to FIG. 3, the development device 100 includes a housing 102 that contains a developer G, a development roller 106, a trimmer 108 that is an exemplary developer regulating member and regulates the thickness of a layer of the developer G (a developer layer) carried by the outer circumferential surface of the development roller 106, a first auger 109 that supplies the developer G to the development roller 106, a second auger 111 that circulates and transports the developer G in combination with the first auger 109, and an accumulation regulating member 110 that regulates the shape of an accumulation of the developer G.

The developer G is, for example, a two-component developer that is composed of negatively chargeable toner particles T as exemplary charged particles and positively chargeable magnetic carrier particles CA as exemplary magnetic particles. The housing 102 contains such an amount of developer G that the first auger 109 and the second auger 111 submerge in the developer G. The amount of developer G carried by the outer circumferential surface of a development sleeve 106B, which will be described below, is referred to as the amount of developer G. The amount of toner carried by the outer circumferential surface of the photoconductor 62 after the development with the developer G is referred to as the amount developed.

The housing 102 includes a container body 103 and a covering member 104 that covers the top of the container body 103. The housing 102 has a development roller chamber 122 in which the development roller 106 is provided, a first stirring chamber 123 provided below the development roller chamber 122 in the Y direction, and a second stirring chamber 124 adjoining the first stirring chamber 123 in the X direction.

The container body 103 includes a bottom wall 103A curving at two positions in the X direction in such a manner as to be convex toward the lower side in the Y direction when seen in the Z direction, a sidewall 103B extending in the Y direction from the left end, in the X direction, of the bottom wall 103A, a sidewall 103C extending upward from the right end, in the X direction, of the bottom wall 103A, and a partition wall 103D extending upward from a central portion of the bottom wall 103A and parting the first stirring chamber 123 and the second stirring chamber 124. The upper end of the sidewall 103B in the Y direction resides below the development roller 106 in the Y direction and has a projecting portion 103E projecting toward the left side in the X direction.

The covering member 104 includes a top wall 104A extending above the second stirring chamber 124, a curved wall 104B extending from the left end, in the X direction, of the top wall 104A toward the upper left and covering the development roller chamber 122, a sloping wall 104C extending from the left end, in the X direction, of the curved wall 104B and sloping toward the development roller 106, a projecting portion 104D projecting from the lower end, in the Y direction, of the sloping wall 104C in the circumferential direction of the development roller 106, and a fitted portion 104E extending from the right end, in the X direction, of the top wall 104A toward the lower side in the Y direction and fitted onto the container body 103. Furthermore, a bracket 114 is provided on the inner side of the curved wall 104B of the covering member 104. The trimmer 108 and the accumulation regulating member 110 are attached to the bracket 114.

The bracket 114 includes a vertical portion 114A extending in the Y direction from a position near the upper end, in the Y direction, of the partition wall 103D, a sloping portion 114B extending from the upper end, in the Y direction, of the vertical portion 114A toward the upper left, and an upper wall 114C extending from the left end, in the X direction, of the sloping portion 114B toward the lower left. The upper end, in the Y direction, of the trimmer 108 is attached to the left end, in the X direction, of the upper wall 114C. The accumulation regulating member 110 is fixedly provided in an area of the development roller chamber 122 that is defined by the sloping portion 114B, the upper wall 114C, and the trimmer 108.

The development roller 106 is provided in the development roller chamber 122. The development roller 106 includes a magnet roller 106A as an exemplary magnetic-force-generating member, the development sleeve 106B as an exemplary developer carrying member, and a shaft 106C. The magnet roller 106A has a cylindrical or substantially cylindrical shape whose axial direction corresponds to the Z direction. The magnet roller 106A is fixedly supported by the container body 103 with the shaft 106C interposed therebetween. The development sleeve 106B has a cylindrical or substantially cylindrical shape and is provided on the outer side of the magnet roller 106A while being rotatably supported at two axial ends thereof. That is, the magnet roller 106A is provided inside the development sleeve 106B.

The magnet roller 106A includes plural magnetic poles arranged along the outer circumferential surface thereof (in the circumferential direction thereof). More specifically, in counterclockwise order from the lower right when seen in the Z direction, the plural magnetic poles include a pickup pole N2 that attracts the developer G, a transport pole S2 that allows the development sleeve 106B, which is rotatable, to transport the developer G, a layer forming pole N1 that faces the trimmer 108, a development pole S1 that faces the photoconductor 62, and a release pole N3 that allows the developer G to be released (separated) from the development sleeve 106B. Lines of magnetic force (not illustrated) extend from the layer forming pole N1 to the development pole S1 and to the transport pole S2, from the pickup pole N2 to the transport pole S2, and from the release pole N3 to the development pole S1.

The positions of the magnetic poles when the magnet roller 106A is seen in the Z direction (the axial direction) will now be described. In the following description, the top of the magnet roller 106A is defined as twelve o'clock, and the bottom of the magnet roller 106A is defined as six o'clock. For example, the pickup pole N2 is at five o'clock and attracts the developer G toward the development sleeve 106B. The transport pole S2 is at two o'clock and attracts the developer G such that the developer G is carried by the outer circumferential surface of the development sleeve 106B while the development sleeve 106B is rotating. The layer forming pole N1 is at eleven o'clock and faces the tip (the lower end in the Y direction) of the trimmer 108. The layer forming pole N1 forms a brush of magnetic carrier particles CA on the outer circumferential surface of the development sleeve 106B.

The development pole S1 is at nine o'clock and faces the outer circumferential surface of the photoconductor 62 (see FIG. 2). The release pole N3 is at seven o'clock and produces a magnetic field acting in such a direction that residues of the developer G remaining after the development performed on the photoconductor 62 (see FIG. 2) are released from the development sleeve 106B, whereby the residues of the developer G are released from the development sleeve 106B in a portion between the pickup pole N2 and the release pole N3.

The development sleeve 106B has at two Z-direction ends thereof cap-type supporting members (not illustrated) that cover the two Z-direction ends. The supporting members each have a ring shape when seen in the Z direction and are each provided with a bearing (not illustrated) fixed thereinside such that the axial direction of the bearing corresponds to the Z direction. When the shaft 106C is inserted into the bearings, the two ends of the development sleeve 106B are supported by the bearings. Thus, the development sleeve 106B is allowed to rotate in the circumferential direction thereof relative to the magnet roller 106A.

One of the supporting members provided at the two ends of the development sleeve 106B has a gear (not illustrated), via which the development sleeve 106B is driven by a motor (not illustrated). The development sleeve 106B is exposed on a side thereof facing the photoconductor 62 (see FIG. 2) and in a portion thereof between the projecting portion 103E and the projecting portion 104D. The development sleeve 106B faces the photoconductor 62 in the X direction (the horizontal direction). The development sleeve 106B is configured to carry the developer G on the outer circumferential surface thereof and to rotate in the circumferential direction thereof.

The first auger 109, which stirs and transports the developer G, is provided in the first stirring chamber 123. The first auger 109 includes a rotating shaft 109A extending in the Z direction and a helical blade 109B provided around the rotating shaft 109A. The first auger 109 faces the development sleeve 106B (the pickup pole N2) at a position on the upstream side of the trimmer 108 in the direction of rotation of the development sleeve 106B. The axial direction of the first auger 109 corresponds to the axial direction of the development sleeve 106B. When the blade 109B of the first auger 109 is rotated, the developer G is transported in the axial direction and is supplied to the development sleeve 106B.

The second auger 111, which stirs and transports the developer G, is provided in the second stirring chamber 124. The second auger 111 includes a rotating shaft 111A extending in the Z direction and a helical blade 111B provided around the rotating shaft 111A. The first auger 109 and the second auger 111 rotate in opposite directions, respectively. Therefore, the developer G is transported in the opposite directions in the first stirring chamber 123 and in the second stirring chamber 124, respectively, whereby the developer G is made to circulate.

The developer G in the first stirring chamber 123 is carried by the development sleeve 106B with the aid of the pickup pole N2 and the transport pole S2 and is transported with the rotation of the development sleeve 106B in the +R direction. The developer G thus carried by the development sleeve 106B advances into a gap between the outer circumferential surface of the development sleeve 106B and the tip (the lower end in the Y direction) of the trimmer 108, whereby the thickness of the developer layer is regulated. The developer layer, whose thickness has been regulated, is transported to a development area facing the photoconductor 62 (see FIG. 2).

The trimmer 108 is a plate-shaped member whose long-side direction corresponds to the Z direction. The trimmer 108 faces the outer circumferential surface of the development sleeve 106B within an area from the transport pole S2 to the photoconductor 62 (see FIG. 2) in the direction of rotation of the development sleeve 106B. The trimmer 108 is tilted such that the tip (the lower end in the Y direction) thereof resides on the X-direction side of the base thereof. The short-side direction of the trimmer 108 corresponds to the direction in which the trimmer 108 is tilted. The tip of the trimmer 108 is oriented toward the shaft 106C. That is, the trimmer 108 is provided above the development sleeve 106B (above a center of rotation O of the development sleeve 106B) in the Y direction and faces the layer forming pole N1 with the development sleeve 106B interposed therebetween. Thus, the trimmer 108 regulates the thickness of the developer layer carried by the outer circumferential surface of the development sleeve 106B.

The accumulation regulating member 110, which is in contact with the sloping portion 114B, the upper wall 114C, and the trimmer 108, is a block provided above the development sleeve 106B in the Y direction. The lower end of the accumulation regulating member 110 in the Y direction (a portion of the accumulation regulating member 110 that faces the development sleeve 106B) forms a regulating portion 110A having an inverse V shape that is recessed in the Y direction when seen in the Z direction. The point at which the regulating portion 110A is most recessed in the Y direction is referred to as deepest point 110B. The accumulation regulating member 110 has a constant sectional shape in the Z direction. The accumulation regulating member 110 also has a dam portion 110C as a surface extending obliquely upward from the upstream end of the regulating portion 110A in the direction of rotation of the development sleeve 106B (in such a direction that the upper end of the dam portion 110C resides on the X-direction side with respect to the Y direction). The angle of tilt of the dam portion 110C is set such that, for example, a vertex GA of developer G' (see FIG. 6) that has been dammed by the dam portion 110C is at an angle of 45 degrees or larger and 90 degrees or smaller with respect to the X direction.

The positions of the trimmer 108 and the regulating portion 110A will now be described.

First, a comparative example to the exemplary embodiment will be described in which the developer G is made to accumulate in the horizontal direction.

Figure 4A:
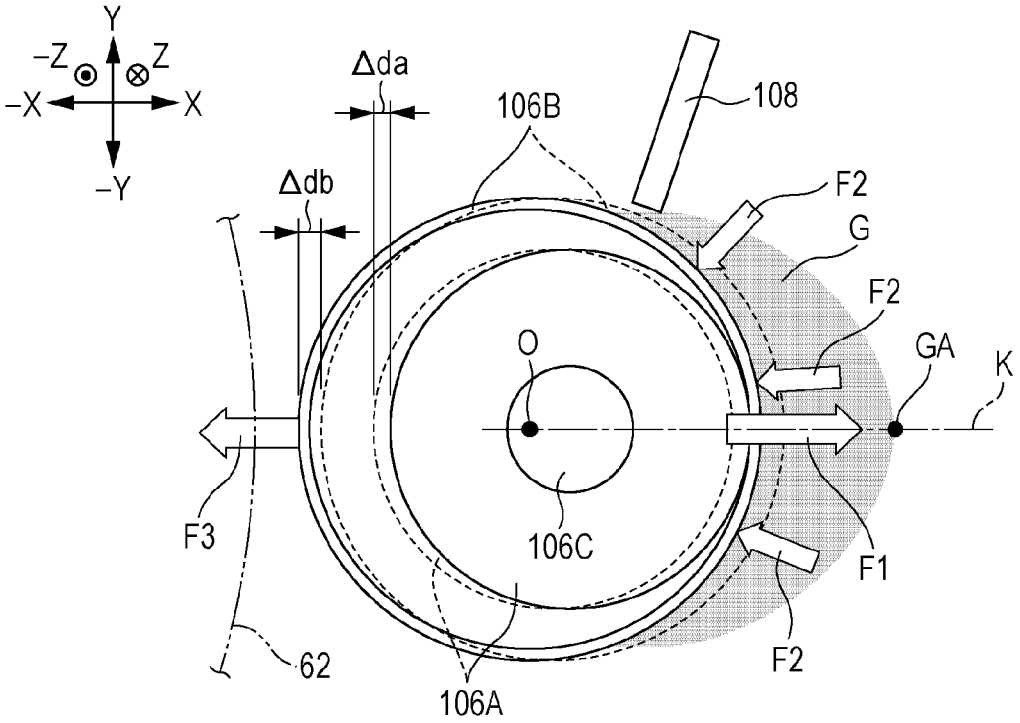
FIG. 4A schematically illustrates a movement of a development sleeve toward a photoconductor that occurs in a comparative example to the exemplary embodiment of the present invention with attractive forces exerted by a magnet roller and a developer.

Referring to FIG. 4A, a center line passing through the center of rotation O of the development sleeve 106B and extending in the X direction is denoted by K. The developer G accumulates in a mountain shape on a side of the development sleeve 106B opposite the photoconductor 62. The vertex of the mountain of developer G carried is denoted by GA. In this case, for example, it is assumed that the mountain of developer G is carried by the outer circumferential surface of the development sleeve 106B such that the vertex GA thereof resides on the center line K.

In FIG. 4A, the positions of the magnet roller 106A and the development sleeve 106B when the two are stationary with no developer G carried by the development sleeve 106B are represented by broken lines. The positions of the magnet roller 106A and the development sleeve 106B that have been bent, as described separately below, are represented by solid lines. Hereinafter, the directions toward the negative sides in the X, Y, and Z directions are occasionally referred to as −X, −Y, and −Z directions, respectively.

Figure 4B:
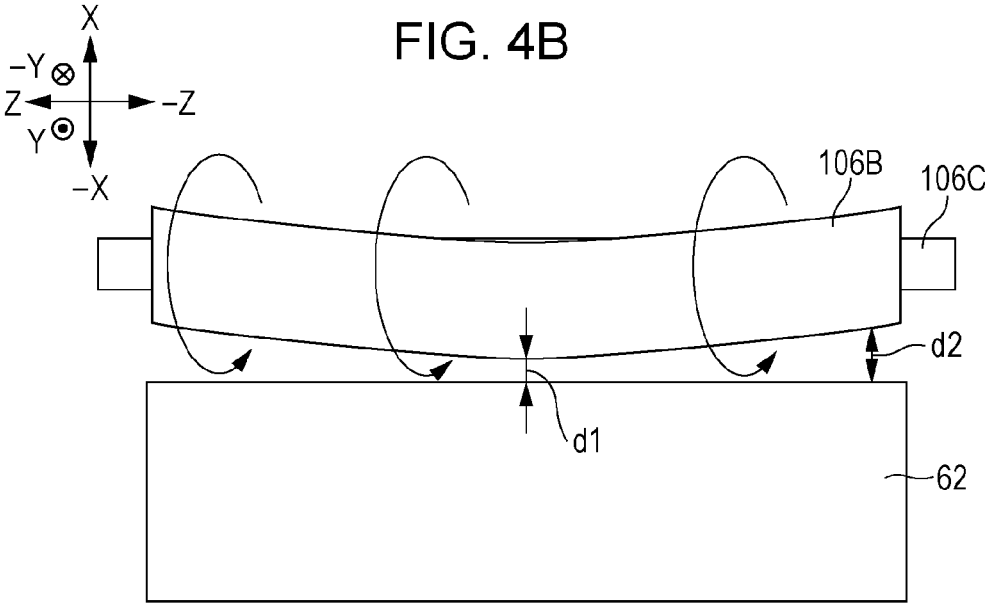
FIG. 4B schematically illustrates that the distance between the photoconductor and the development sleeve according to the comparative example to the exemplary embodiment of the present invention differs between that at the center of the development sleeve and that at each end of the development sleeve.

When the development sleeve 106B (in the state illustrated in FIG. 4A) is rotated, referring now to FIG. 4B, the distance between the outer circumferential surface of the development sleeve 106B and the outer circumferential surface of the photoconductor 62 becomes d1 at the −Z-direction center of the development sleeve 106B and d2 at a −Z-direction end of the development sleeve 106B (also at a Z-direction end of the development sleeve 106B), where d1<d2. That is, since the development sleeve 106B bends toward the photoconductor 62 at the center thereof that is not supported, the distance (d1) between the development sleeve 106B and the photoconductor 62 at the center becomes smaller. If image formation is performed by the image forming apparatus 10 (see FIG. 1) in such a state, an excessive amount of toner may be supplied to a central portion of the recording sheet P in the width direction (the Z direction) compared with the amount of toner expected to be supplied to end portions of the recording sheet P in the same direction. Consequently, the image density becomes higher in the central portion than in the end portions.

Now, a mechanism of how the development sleeve 106B bends at the Z-direction center thereof will be described.

Referring to FIG. 4A, since the magnet roller 106A and the developer G both have magnetism, the magnet roller 106A and the developer G attract each other with an attractive force F1 acting on the magnet roller 106A in the X direction. Since the magnet roller 106A and the developer G come closer to each other (since the magnet roller 106A is displaced in the X direction by a length Δda), the development sleeve 106B receives pressing forces F2 acting in the radial direction from the developer G.

Since the developer G has a mountain shape with the vertex GA, i.e., the center, thereof residing on the center line K, one of the pressing forces F2 acting on the development sleeve 106B along the center line K is the largest (the largest pressing force is hereinafter denoted by F3). Hence, the development sleeve 106B comes closer to the photoconductor 62 in the horizontal direction (the development sleeve 106B is displaced in the −X direction by a length Δdb).

The development sleeve 106B is supported by the housing 102 (see FIG. 3) at the Z-direction ends thereof but not at the Z-direction center thereof. Hence, the lengths Δda and Δdb are larger at the center of the development sleeve 106B than at the ends of the development sleeve 106B. Thus, as illustrated in FIG. 4B, the development sleeve 106B bends such that the center thereof comes closer to the photoconductor 62 than the ends thereof.

Figure 5A:
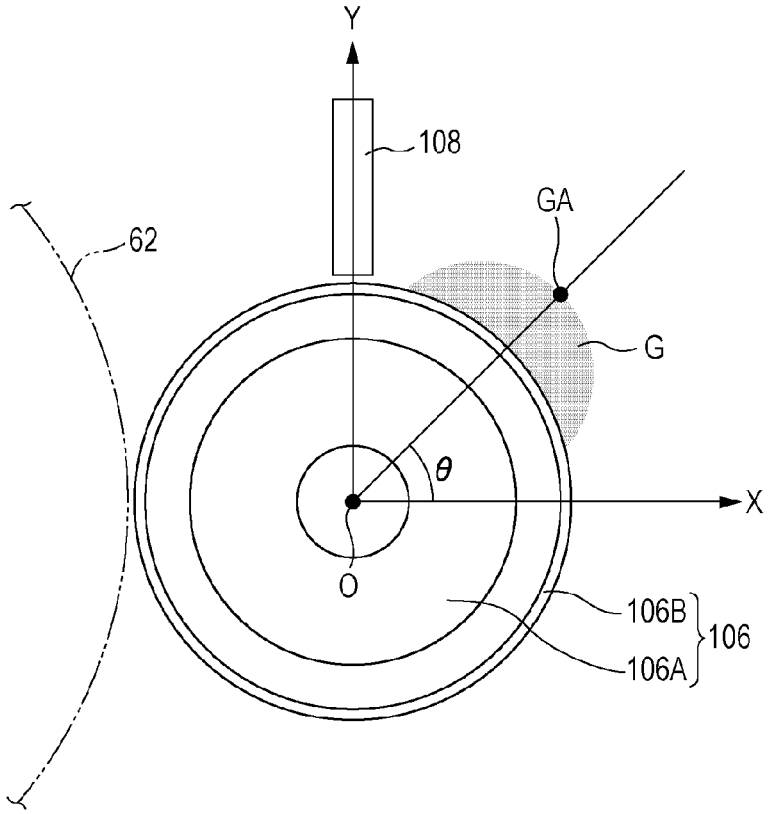
FIG. 5A schematically illustrates an experiment in which the amount of developer to be carried by the development sleeve according to the exemplary embodiment of the present invention is increased at a constant circumferential position of the development sleeve.

To demonstrate the above mechanism, an experiment is conducted in which the amount of developer G to be carried by the development sleeve 106B is varied while the development sleeve 106B is stationary. More specifically, referring to FIG. 5A, the trimmer 108 is oriented straight such that the short side thereof extends in the Y direction, and the development sleeve 106B is made to carry an accumulation of developer G such that the vertex GA resides on a virtual line tilting at an angle θ of 45 degrees with respect to the X direction toward the Y-direction side. In this state, the amount of developer G to be carried is varied and the displacements of the development sleeve 106B in the X direction and in the Y direction are measured. The amount of developer G to be carried is varied among 0 g (none), 300 g, and 360 g. The displacements of the development sleeve 106B are measured with a laser displacement gauge.

Figure 5B:
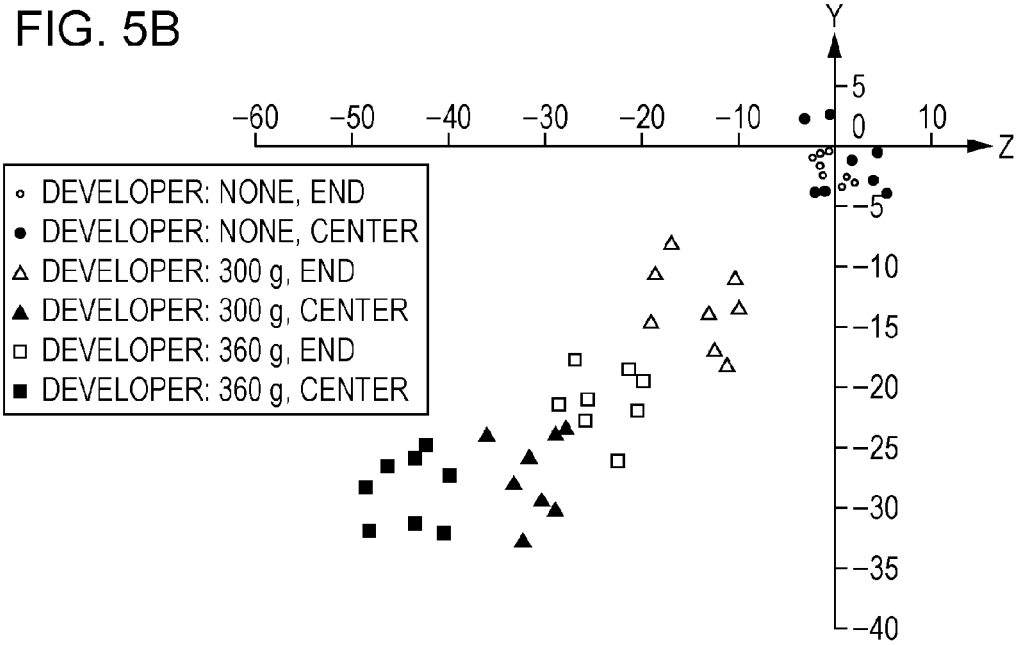
FIG. 5B is a graph illustrating displacements of the development sleeve at the center and at each end thereof that are measured with different amounts of developer carried at the constant circumferential position of the development sleeve according to the exemplary embodiment of the present invention.

Referring to FIG. 5B, with no developer G, there is substantially no difference between the displacements of the development sleeve 106B (see FIG. 5A) at the Z-direction center and at the Z-direction end, that is, the displacements are plotted near the origin expressed by (X, Y)=(0, 0). Note that the data are obtained through measurements performed for one of the two ends of the development sleeve 106B, and measurements for the other end of the development sleeve 106B are omitted.

With 300 g of developer G, the development sleeve 106B moves farther from the origin, that is, the development sleeve 106B is more displaced toward the photoconductor 62 (see FIG. 5A), at the center thereof than at the end thereof. Similarly, with 360 g of developer G, the development sleeve 106B moves farther from the origin, that is, the development sleeve 106B is more displaced toward the photoconductor 62, at the center thereof than at the end thereof. Comparing the case where 300 g of developer G is carried and the case where 360 g of developer G is carried, the development sleeve 106B is displaced farther from the origin in the case where 360 g of developer G is carried than in the case where 300 g of developer G is carried, and the direction of bending (displacement) in the development sleeve 106B is at about 45 degrees with respect to the −X direction toward the −Y-direction side. That is, referring to FIG. 5A, the direction in which the amount of bending (displacement) in the development sleeve 106B caused by an accumulation of developer G is largest corresponds to a direction in which a line connecting the vertex GA of the accumulation of developer G and the center of rotation O of the development sleeve 106B extends.

Thus, the development sleeve 106B bends toward a side of the center of rotation O thereof opposite the vertex GA of the accumulation of developer G. To make the amount of bending in the development sleeve 106B in the horizontal direction smaller than that in the vertical direction, the trimmer 108 may be positioned such that the center angle defined between the vertex GA of the accumulation of developer G and the trimmer 108 is 45 degrees or larger in the direction of rotation of the development sleeve 106B. Hence, the trimmer 108 is positioned such that the vertex GA of the accumulation of developer G resides at a position near a virtual vertical line passing through the center of rotation O of the development sleeve 106B.

Figure 6:
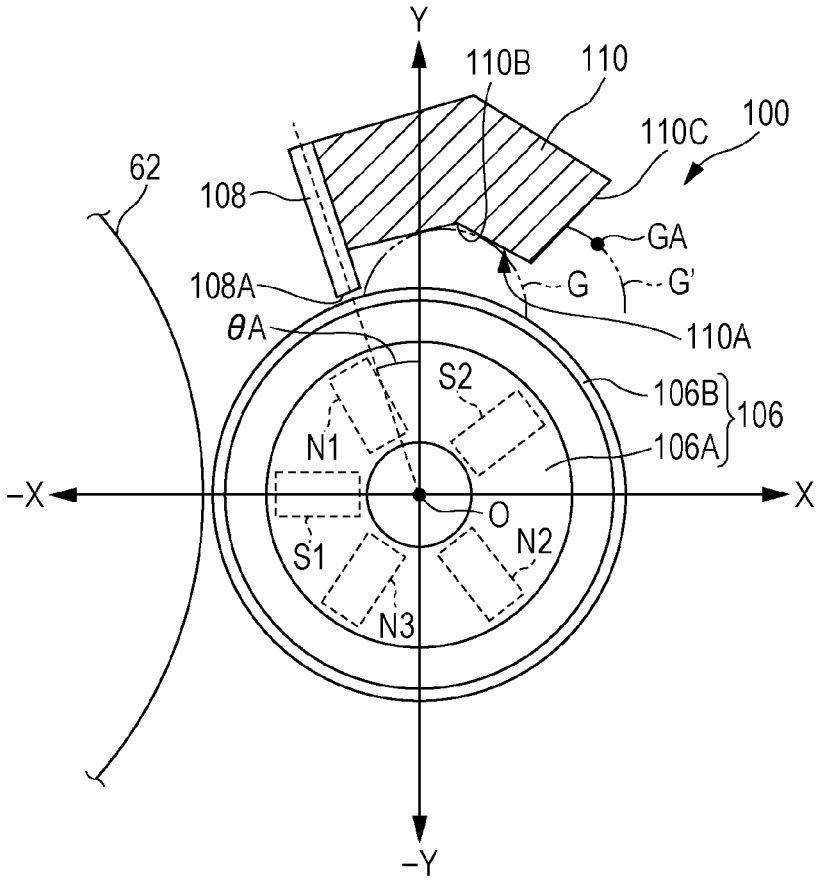
FIG. 6 schematically illustrates the positions of a trimmer and an accumulation regulating member according to the exemplary embodiment of the present invention.

In view of the above, referring to FIG. 6, the development device 100 according to the exemplary embodiment is configured such that a tip 108A of the trimmer 108 resides on a side of the center of rotation O of the development sleeve 106B that is nearer to the photoconductor 62 in the X direction (the horizontal direction). Furthermore, the trimmer 108 is tilted with respect to the Y direction toward a −X-direction side at an angle θA (for example, 0 degrees≤θA≤45 degrees). Furthermore, the accumulation regulating member 110 is provided at a position between the transport pole S2 and the trimmer 108 in the direction of rotation of the development sleeve 106B and facing the development sleeve 106B.

Furthermore, the regulating portion 110A of the accumulation regulating member 110 is set such that the deepest point 110B resides at the highest position in the Y direction among all points of the regulating portion 110A. That is, the transport pole S2 and the trimmer 108 are positioned such that a vertical component of the pressing force acting on the development sleeve 106B from the developer G (not illustrated) that is magnetically attracted to the transport pole S2 while the development sleeve 106B is rotated becomes larger than a horizontal component of the pressing force.

Operations

Operations according to the exemplary embodiment will now be described.

In the image forming apparatus 10 (the development device 100) illustrated in FIG. 3, when the first auger 109 and the second auger 111 rotate, the developer G contained in the housing 102 is made to circulate while being stirred and is transported. The developer G having been transported to the first stirring chamber 123 is supplied to the development sleeve 106B with the magnetic force exerted by the pickup pole N2 and the transport pole S2 and is carried by the outer circumferential surface of the development sleeve 106B. The developer G on the outer circumferential surface of the development sleeve 106B is transported with the rotation of the development sleeve 106B while the thickness thereof is regulated by the trimmer 108.

Figure 7A:
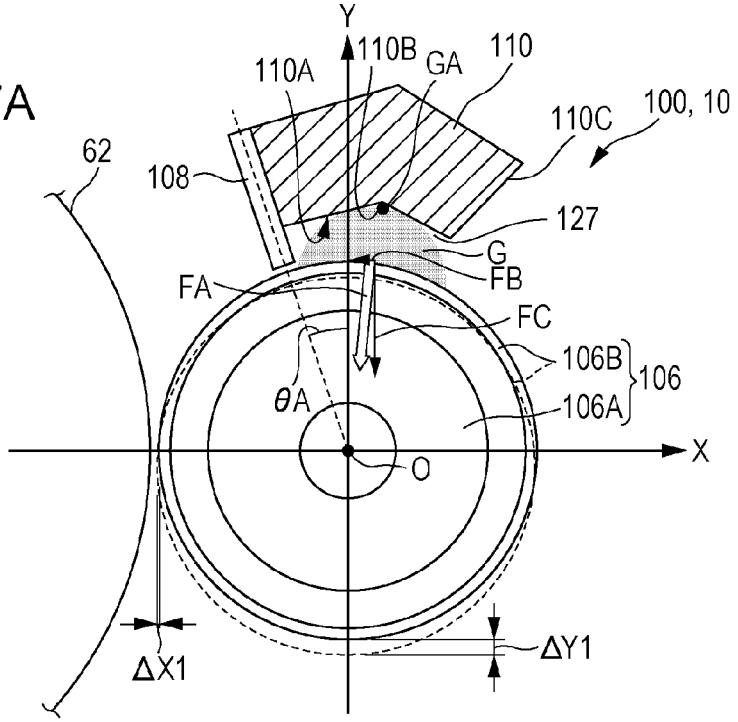
FIGS. 7A and 7B schematically illustrate forces acting on the development sleeve with the trimmer according to the exemplary embodiment of the present invention provided at different positions.

Referring to FIG. 7A, the developer G having accumulated in a developer accumulating chamber 127, which is a space defined by the development sleeve 106B, the trimmer 108, and the accumulation regulating member 110, is formed into a mountain shape conforming to the recess defined by the regulating portion 110A. The vertex GA of the accumulation of developer G in the developer accumulating chamber 127 resides near a position straight above the center of rotation O of the development sleeve 106B in the Y direction (near the deepest point 110B). Furthermore, a pressing force FA exerted by the developer G pressing the development sleeve 106B (a load applied to the development sleeve 106B) acts in a direction close to the vertical direction (a downward direction).

Hence, a horizontal component FB of the pressing force FA is smaller than a vertical component FC of the pressing force FA. Consequently, the development sleeve 106B rotates while being bent in the vertical direction at the center thereof, at which the development sleeve 106B is not supported. That is, the development sleeve 106B rotates in a state where an amount of bending ΔX1 in the horizontal direction is smaller than an amount of bending ΔY1 in the vertical direction.

In the image forming apparatus 10, the horizontal component of the load to be applied to the development sleeve 106B is reduced as described above. Therefore, the displacement of the development sleeve 106B at the center thereof toward the photoconductor 62 is reduced. Furthermore, in the image forming apparatus 10, the difference in the distance from the photoconductor 62 to the development sleeve 106B is little between that at the axial-direction (Z-direction) center of the photoconductor 62 and that at each axial-direction (Z-direction) end of the photoconductor 62. This reduces the probability that the amount developed (the amount of toner) that is obtained after the development may become larger at the width-direction (Z-direction) center of the photoconductor 62 than at each width-direction (Z-direction) end of the photoconductor 62.

Referring to FIG. 6, when a large amount of developer G advances toward the regulating portion 110A of the accumulation regulating member 110, the developer G may be dammed by the dam portion 110C and may be formed into a mountain shape as illustrated as developer G' represented by a dash-dot-dot-line. In such a case, the amount of developer G' dammed may become larger than the amount of developer G accumulated in the developer accumulating chamber 127. The developer G' dammed by the dam portion 110C accumulates such that the vertex GA thereof resides within an area defined by an angle of 45 degrees or larger and 90 degrees or smaller with respect to the X direction in accordance with the angle of tilt of the dam portion 110C. Therefore, the pressing force FA (see FIG. 7A) applied to the development sleeve 106B from the developer G' acts in a direction close to the vertical direction (a downward direction). That is, the position where the height of the accumulation of developer G is largest is controlled by both the regulating portion 110A and the dam portion 110C of the accumulation regulating member 110.

Referring to FIG. 7A, in the image forming apparatus 10, the trimmer 108 is positioned above the center of rotation O of the development sleeve 106B in the vertical direction. Therefore, the developer G is easily carried by the development sleeve 106B (the developer G does not tend to fall from the development sleeve 106B).

Furthermore, in the image forming apparatus 10, the tip 108A of the trimmer 108 is positioned on the side of the center of rotation O of the development sleeve 106B that is nearer to the photoconductor 62 in the X direction. Therefore, the developer G stays on the development sleeve 106B. Hence, the developer G does not tend to fall from the development sleeve 106B, and the developer G easily accumulates. Since the developer G easily accumulates, the reduction in the vertical component FC due to falling of the developer G is suppressed.

In addition, since the image forming apparatus 10 includes the accumulation regulating member 110, the position of the vertex GA of the accumulation of developer G is arbitrarily settable by changing the position to which the accumulation regulating member 110 is attached and the shapes of the regulating portion 110A (the deepest point 110B) and the dam portion 110C. Hence, it is easy to control the position of the vertex GA where the height of the accumulation of developer G carried is largest.

Figure 8A:
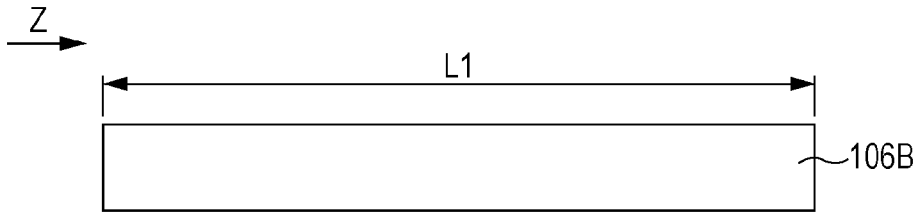
FIG. 8A schematically illustrates the external shape of the development sleeve according to the exemplary embodiment of the present invention.

Here, the displacement of the development sleeve 106B in the −X direction are measured with a laser displacement gauge in the comparative example illustrated in FIG. 4A in which the vertex GA of the accumulation of developer G resides on the center line K and in the exemplary embodiment illustrated in FIG. 7A in which the vertex GA of the accumulation of developer G resides near a position vertically above the center of rotation O of the development sleeve 106B. As illustrated in FIG. 8A, the length of the development sleeve 106B in the Z direction is denoted by L1.

Figure 8B:
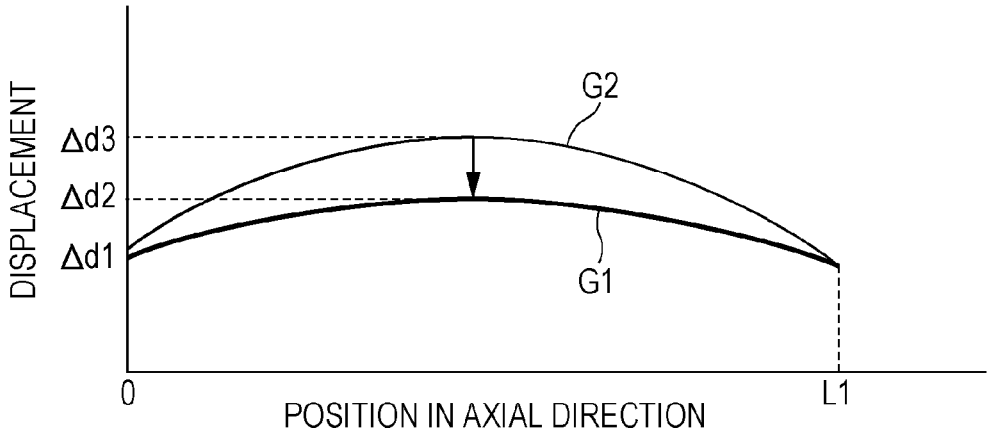
FIG. 8B is a graph illustrating displacements of the development sleeve with respect to the position of the development sleeve in the axial direction in the exemplary embodiment of the present invention and in the comparative example.

The results are illustrated in FIG. 8B. Suppose that different measured displacements are expressed as $\Delta d1<\Delta d2<\Delta d3$. A curve G2 for the comparative example shows that the displacement at an end is $\Delta d1$ and the displacement at the center is $\Delta d3$. A curve G1 for the exemplary embodiment shows that the displacement at an end is $\Delta d1$ and the displacement at the center is $\Delta d2$. The results show that the difference between the displacement at the X-direction center and the displacement at the X-direction end is smaller in the exemplary embodiment in which the vertex GA resides near a position vertically above the center of rotation O than in the comparative example in which the vertex GA resides on the center line K extending in the horizontal direction.

Furthermore, image density is measured for an image formed by the development device according to the comparative example in which the vertex GA of the accumulation of developer G resides on the center line K extending in the horizontal direction and for an image formed by the development device 100 (see FIG. 7A) according to the exemplary embodiment. The measurements are conducted with, for example, X-Rite 404 manufactured by X-Rite Incorporated.

Figure 8C:
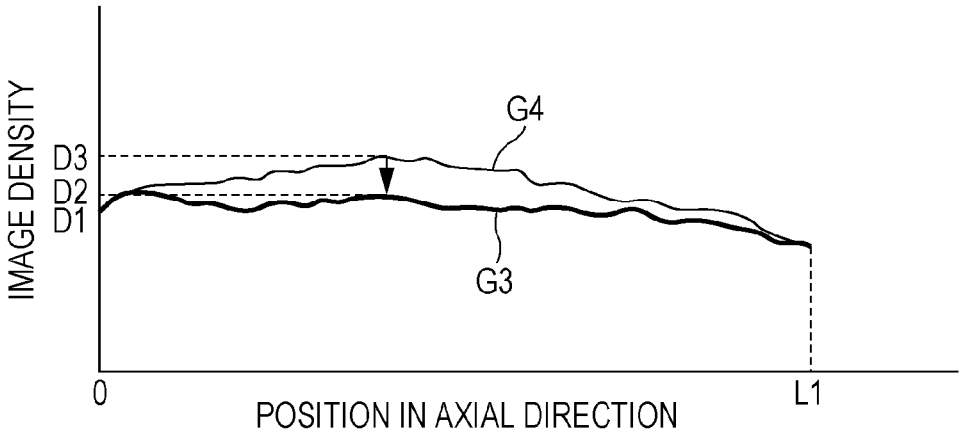
FIG. 8C is a graph illustrating changes in the image density with respect to the position of the development sleeve in the axial direction in the exemplary embodiment of the present invention and in the comparative example.

The results are illustrated in FIG. 8C. Suppose that different measured image densities are expressed as D1<D2<D3. A curve G4 for the comparative example shows that the image density at an end is D1 and the image density at the center is D3. A curve G3 for the exemplary embodiment shows that the image density at an end is D1 and the image density at the center is D2. The results show that the difference between the image density at the Z-direction center and the image density at the Z-direction end is smaller in the exemplary embodiment in which the vertex GA resides near a position vertically above the center of rotation O than in the comparative example in which the vertex GA resides on the center line K extending in the horizontal direction.

The present invention is not limited to the above exemplary embodiment.

Figure 7B:
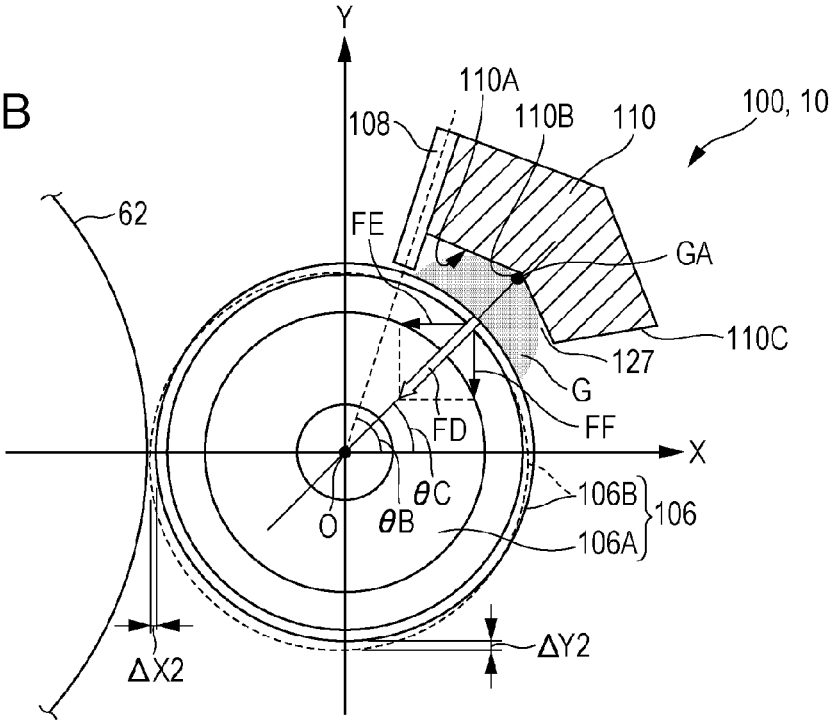

As illustrated in FIG. 7B, assuming that the X direction is at 0 degrees, the trimmer 108 may be tilted at an angle θB with respect to the X direction that is set within a range of 45 degrees≤θB≤90 degrees and the vertex GA of the accumulation of developer G may be at an angle θC with respect to the X direction that is set within a range of 45 degrees≤θC≤90 degrees. If the angle θC is 45 degrees, a pressing force FD acts on the development sleeve 106B at 45 degrees, making a horizontal component FE of the pressing force FD equal to a vertical component FF of the pressing force FD. That is, the horizontal component FE does not become larger than the vertical component FF. Hence, the development sleeve 106B rotates with an amount of bending ΔX2 in the horizontal direction that is smaller than or equal to an amount of bending ΔY2 in the vertical direction.

The regulating portion 110A of the accumulation regulating member 110 may alternatively have a curved shape. Moreover, the accumulation regulating member 110 is not necessarily of a block type and may alternatively be of a plate type.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrying member configured to carry a latent image on an outer circumferential surface thereof;

a developer carrying member having a substantially cylindrical shape and rotatably supported at two ends thereof, the developer carrying member facing the image carrying member in a horizontal direction and being configured to carry on an outer circumferential surface thereof a developer containing magnetic particles and to rotate in a circumferential direction thereof;

a transport pole provided inside the developer carrying member and above a center of rotation of the developer carrying member in a vertical direction, the transport pole being one of a plurality of magnetic poles included in a magnetic-force-generating member that are arranged in the circumferential direction of the developer carrying member, the transport pole allowing the developer carrying member to transport the developer while the developer carrying member is rotating; and a developer regulating member facing the developer carrying member at a position between the transport pole and the image carrying member in a direction of rotation of the developer carrying member and configured to regulate a thickness of a layer of the developer on the outer circumferential surface of the developer carrying member, the developer regulating member being provided at such a position that, when the developer carrying member rotates, the developer accumulates at a position where a first amount of bending in the developer carrying member in the vertical direction becomes larger than or equal to a second amount of bending in the developer carrying member in the horizontal direction.

2. The image forming apparatus according to claim 1, wherein a tip of the developer regulating member resides on a side of the center of rotation of the developer carrying member that is nearer to the image carrying member in the horizontal direction.

3. The image forming apparatus according to claim 1, further comprising an accumulation regulating member configured to regulate a shape of an accumulation of the developer, the accumulation regulating member facing the developer carrying member at a position between the transport pole and the developer regulating member in the circumferential direction of the developer carrying member.

* * * * *